US005692272A

United States Patent [19]

Woods

[11] Patent Number: 5,692,272

[45] Date of Patent: Dec. 2, 1997

[54] CLIP FOR GRIPPING SHEET MATERIAL

[76] Inventor: Lydia A. Woods, 6889 NW. 28th Way, Ft. Lauderdale, Fla. 33309

[21] Appl. No.: 766,333

[22] Filed: Dec. 16, 1996

[51] Int. Cl.[6] ..... B42F 1/00; F16G 11/00

[52] U.S. Cl. ..... 24/459; 24/115 M; 24/460

[58] Field of Search ..... 24/459, 460, 461, 24/462, 115 M, 136 R

[56] References Cited

U.S. PATENT DOCUMENTS

| | | | |
|---|---|---|---|
| 395,207 | 12/1888 | Bowen | 24/136 R |
| 2,585,039 | 2/1952 | Caldwell et al. | 24/261 |
| 3,318,224 | 5/1967 | Bohanon | 24/462 |
| 3,960,461 | 6/1976 | Sachs | 24/115 M |
| 4,333,649 | 6/1982 | Vaughn et al. | 24/115 M |
| 4,455,717 | 6/1984 | Gray | 24/115 M |
| 4,686,748 | 8/1987 | Kaivanto | 24/460 |
| 4,913,672 | 4/1990 | Martin | 441/40 |
| 5,203,860 | 4/1993 | Bollant | 441/40 |
| 5,342,229 | 8/1994 | Whitt | 441/6 |

FOREIGN PATENT DOCUMENTS

| | | | |
|---|---|---|---|
| 0212516 | 12/1960 | Austria | 24/460 |
| 0692231 | 8/1964 | Canada | 24/115 M |
| 1456013 | 10/1966 | France | 24/460 |

*Primary Examiner*—Victor N. Sakran
*Attorney, Agent, or Firm*—Oltman, Flynn & Kubler

[57] ABSTRACT

The invention is a two-part clip for the purpose of securely holding fabric or sheet material without damaging said material. The clip consists of a U-shaped body with an angled cavity and a wedge which is angled to fit snugly into the cavity. An additional component of the invention is a section of rope which is passed through a hole, first in the wedge, then through a hole in the body of the clip.

The fabric to be secured is inserted into the cavity on either the top or the bottom of the wedge. As tension is applied to the rope, the wedge becomes firmly seated in the cavity, thus securing the fabric.

10 Claims, 2 Drawing Sheets

CLIP FOR GRIPPING SHEET MATERIAL

FIELD OF INVENTION

This invention relates to clips for the purpose of holding fabric.

BACKGROUND

There exists a need for a gripping clip for sheet material where the jaws or gripping surface of the clip causes no deformity to the material. This need is particularly outstanding for thin, slippery vinyl. The present method for securing tarpaulins, banners, signs, etc., is to install grommets which weaken the fabric and it is often impractical to replace rusted or corroded grommets.

SUMMARY

The present invention is a two-piece clip using a wedge/angle principal. A tapered wedge and a corresponding angled cavity comprise the two parts of the clip.

The material to be secured is placed on either broad surface of the wedge and then inserted into the cavity of the body of the clip. In one version the wedge is held in place by tension on a rope which is placed through a hole in the wedge, then through a hole in the body of the clip. A knot or clamp on the rope at the wedge end prevents it from being pulled through.

In an alternate version, a raised ridge on the wedge would lock into a corresponding indentation in the body of the clip. An extended tab with a hole at the rear surface of the clip would provide a fastening method.

DETAILED DESCRIPTION

Figure 1:
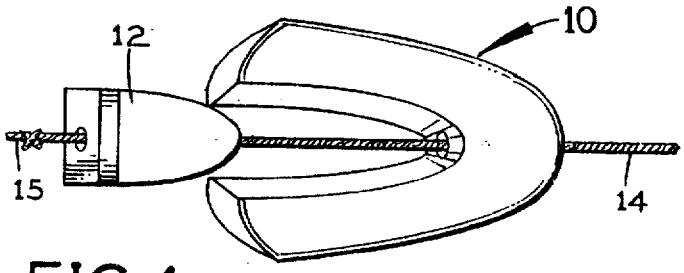
FIG. 1 is a perspective view of the wedge, clip and rope.
Figure 2:
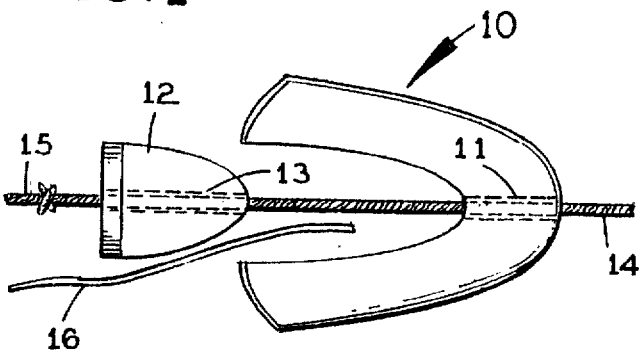
FIG. 2 is a side view showing the position of the material to be held.
Figure 3:
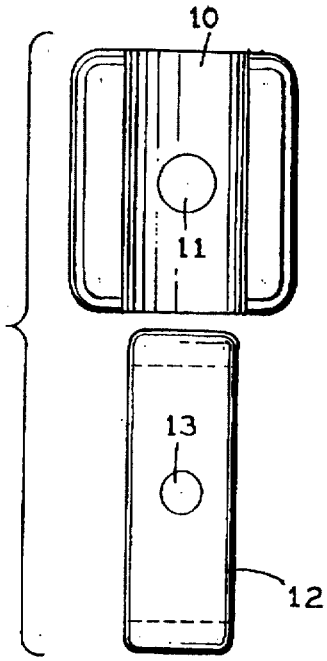
FIG. 3 is a front view showing position of the holes.

FIG. 2 shows the clip 10 with the rope 14 in position through the hole 11 and through the hole 13 in the wedge 12 and knotted 15 to prevent it from being pulled through. The material 16 to be secured is in position. Holding the clip 10 and material 16 stationary, a pull is exerted on the rope 14 away from the clip 10 drawing the wedge 12 into the angled cavity, firmly securing the material 16. In fact, the harder the pull on the rope 14, the firmer the grasp on the fabric 16.

Figure 4:
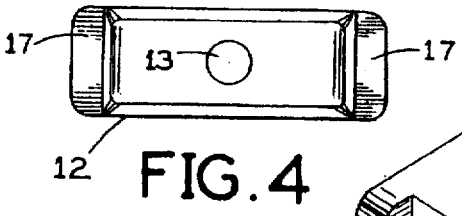
FIG. 4 is an end view showing tabs for easy removal.

FIG. 4 views the wedge 12 from the narrow end showing the extended tabs 17 to facilitate easy removal.

Figure 5A:
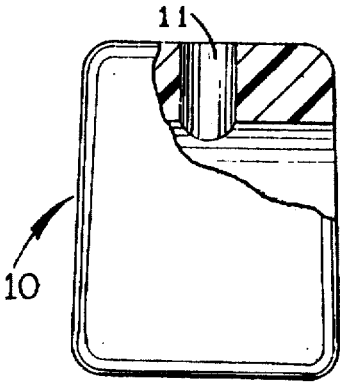
FIG. 5 is a top view of clip and wedge.
Figure 5B:
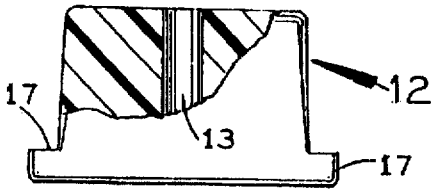

FIG. 5 shows a top view of the clip 10 and wedge 12 with extended tabs 17.

Figure 6:
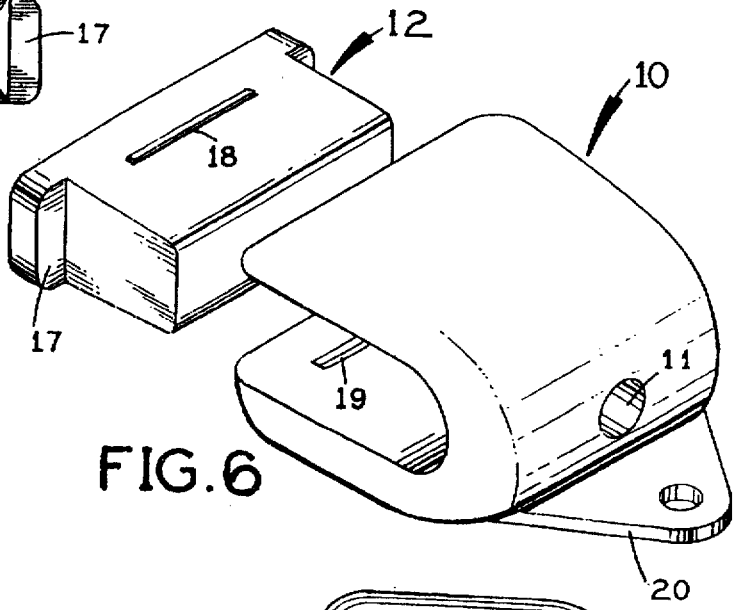
FIG. 6 is a perspective view of the alternate version equipped with locking ridge, indentation and fastening tab.

FIG. 6 depicts the alternate version which has an added ridge 18 on the wedge 12 and a corresponding indentation 19 on the inner surface of the clip 10. This ridge 18 and indent 19 locks the assembly in place making tension on a rope unnecessary. This version is equipped with a tab 20 for mounting.

Figure 7:
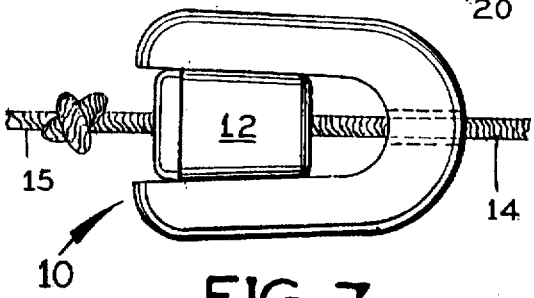
FIG. 7 shows the wedge fully seated into the body of the clip.

FIG. 7 shows the wedge 12 fully seated into the body of the clip 10.

Figure 8A:
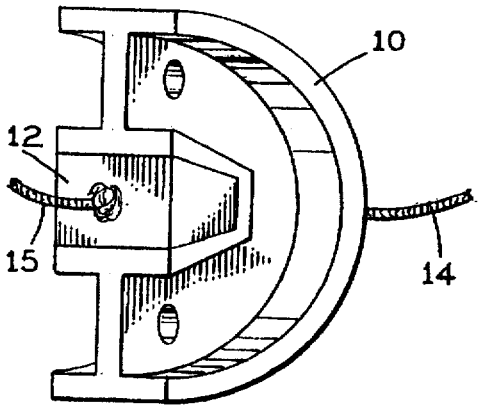
FIG. 8, 9 are alternates for design purposes only.

FIG. 8A is a perspective view of an alternate design to conserve manufacturing material.

Figure 8B:
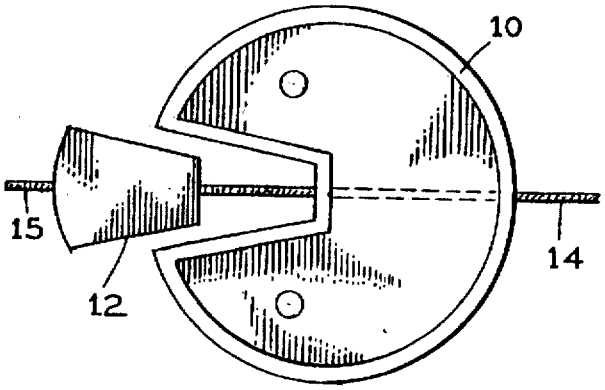

FIG. 8B is a side view of an alternate design.

Figure 9A:
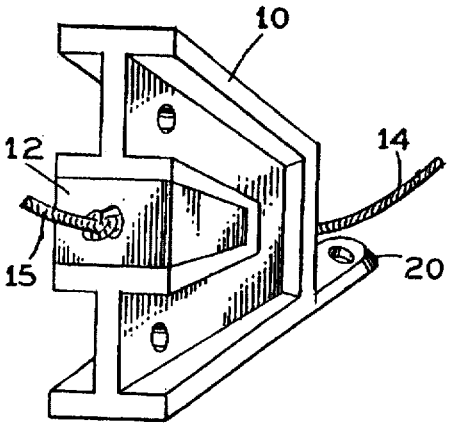

FIG. 9A is a perspective view of an alternate design.

Figure 9B:
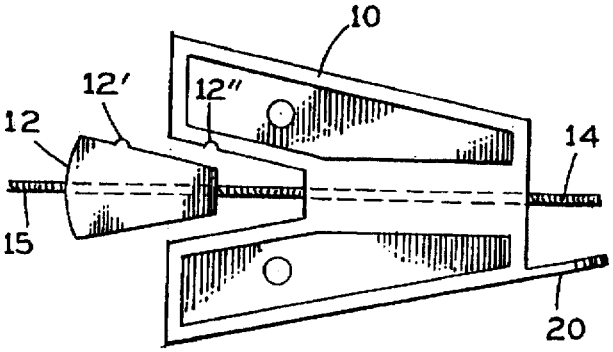

FIG. 9B is a side view of an alternate design.

I claim:

1. A two piece clip assembly comprising a one-piece body having an angled cavity with laterally open sides, a one-piece angled wedge to be inserted into said angled cavity of the body of the clip, the wedge and clip body each having a hole through which a length of rope is threaded and ties, so that as tension is applied to the rope, the wedge becomes more firmly seated in said body of the clip.

2. The clip assembly of claim 1, wherein a rod is substituted for said rope.

3. The two-piece clip assembly of claim 2 wherein said wedge has a width greater than the width of said body between said open sides for facilitating gripping of said wedge for removal purposes.

4. The two-piece clip assembly of claim 3 wherein said body has an indentation, and said wedge has a protrusion for snap-fitting in said indentation for releasably holding said wedge and body together.

5. The clip assembly of claim 1, wherein said wedge has a ridge, and said angled surface of said body of said clip has a corresponding indentation, said ridge and indent providing a snap-fit interlock function in order to decrease the reliance of the tension on said rope.

6. The clip assembly of claim 1, wherein a mounting tab is molded at the rear of said body of said clip.

7. The clip assembly of claim 1, wherein said wedge is of a reduced dimension to allow for holding material of increased thickness.

8. The clip assembly of claim 1, wherein said body and said wedge are fabricated from a plastic compound.

9. The clip assembly of claim 1, wherein said body and said wedge are fabricated of metal.

10. A two-piece clip assembly for holding sheet material comprising a one-piece body having an angled cavity with laterally open sides, a one-piece angled wedge fitting in said angled cavity of said body, said wedge and said body having aligned holes therein through which a single strand of rope is threaded and tied at one end, so that when tension is applied to said rope, said wedge becomes more firmly seated in said body of the clip, and a sheet of material held between said body and said wedge.

* * * * *